United States Patent [19]

Carlson

[11] 3,938,938

[45] Feb. 17, 1976

[54] IGNITION SYSTEM AND COMPONENTS THEREOF

[75] Inventor: Elmer A. Carlson, Agoura, Calif.

[73] Assignee: International Telephone and Telegraph Corporation, New York, N.Y.

[22] Filed: Nov. 25, 1974

[21] Appl. No.: 526,742

Related U.S. Application Data

[62] Division of Ser. No. 447,889, March 4, 1974, Pat. No. 3,870,929.

[52] U.S. Cl. ..... 431/78; 307/106; 317/96; 307/106

[51] Int. Cl.[2] ..... F23N 5/12

[58] Field of Search ..... 431/66, 67, 78, 254; 317/96

[56] References Cited

UNITED STATES PATENTS

| | | | |
|---|---|---|---|
| 3,649,156 | 3/1972 | Conner | 431/78 |
| 3,662,185 | 5/1972 | Sapir | 431/66 X |
| 3,748,083 | 7/1973 | Finger | 431/66 |
| 3,806,305 | 4/1974 | Dietz | 431/264 |
| 3,818,277 | 6/1974 | Gersing | 431/264 X |

*Primary Examiner*—Edward G. Favors
*Attorney, Agent, or Firm*—A. Donald Stolzy

[57] ABSTRACT

A system for igniting, by a spark, the main burner of a gas fired device without the use of a pilot light from, for example, 12 or 24 volts. A unique oscillator provides the spark power and voltage. The oscillator also supplies the power to open the gas valve. A capacitor momentarily opens the valve. The valve is maintained open when a flame is present at the main burner.

12 Claims, 11 Drawing Figures

IGNITION SYSTEM AND COMPONENTS THEREOF

This is a divisional application of copending application Ser. No. 447,889 filed Mar. 4, 1974 now U.S. Pat. No. 3,870,929. The benefit of the filing date of said copending application is, therefore, hereby claimed.

BACKGROUND OF THE INVENTION

This invention relates to combustible fuel ignition systems, and more particularly, to a system for pilotless ignition and components thereof.

In the past, the use of a pilot burner has been relatively safe but does waste a significant amount of gas.

SUMMARY OF THE INVENTION

In accordance with the present invention, the above-described and other disadvantages of the prior art are overcome by providing a system for igniting a main burner and a spark oscillator therefor.

In accordance with another feature of the invention, a fuel valve is turned on momentarily, and then shut off if combustion fails to take place.

The above-described and other advantages of the present invention will be better understood from the following detailed description when considered in connection with the accompanying drawings.

BRIEF DESCRIPTION OF THE DRAWINGS

In the drawings which are to be regarded as merely illustrative.

DESCRIPTION OF THE PREFERRED EMBODIMENTS

Figure 1:
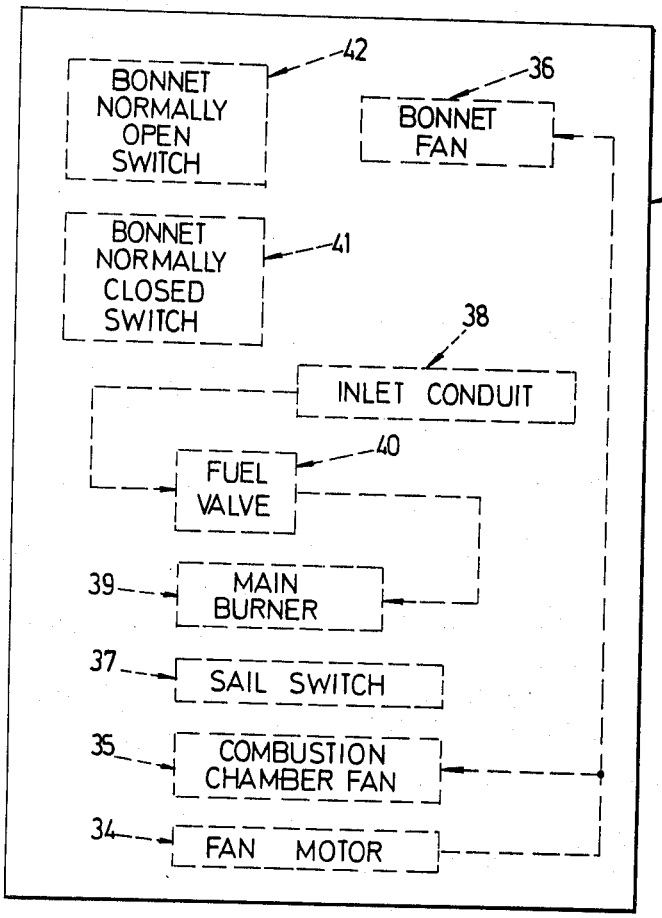
FIG. 1 is a block diagram of a fuel combustion system.

Fuel combustion apparatus is illustrated in FIG. 1 including a fan motor 34 which drives both a combustion fan 35 and a bonnet fan 36. A sail switch is indicated at 37. An inlet conduit is illustrated at 38 connected to a main burner 39 by a fuel valve 40. A normally closed bonnet switch is illustrated at 41. A normally open bonnet switch is illustrated at 42.

Fan motor 34 is turned on by normally open bonnet switch 42 when the temperature in the bonnet is sufficiently high. The normally closed bonnet switch 41 turns off the power except for the fan motor when the temperature of the bonnet exceeds a safe value. Both of the bonnet switches 41 and 42 are temperature operated.

Everything shown in FIG. 1 is conventional. Combustion chamber fan motor 34 drives out whatever gas may be filling this chamber prior to ignition. The sail switch 37 is located in an air duct from the bonnet fan 36 or from the combustion chamber fan 35, but preferably, the latter. Sail switch 37 is normally open and is closed when the air velocity is at or above a predetermined magnitude.

Figure 3:
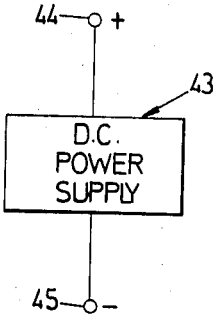
FIG. 3 is a block diagram of a power supply.

One embodiment of the system of the present invention may be operated from a 12 or 24 volt power supply as indicated at 43 in FIG. 3 having a positive terminal 44 and a negative terminal 45.

Figure 4:
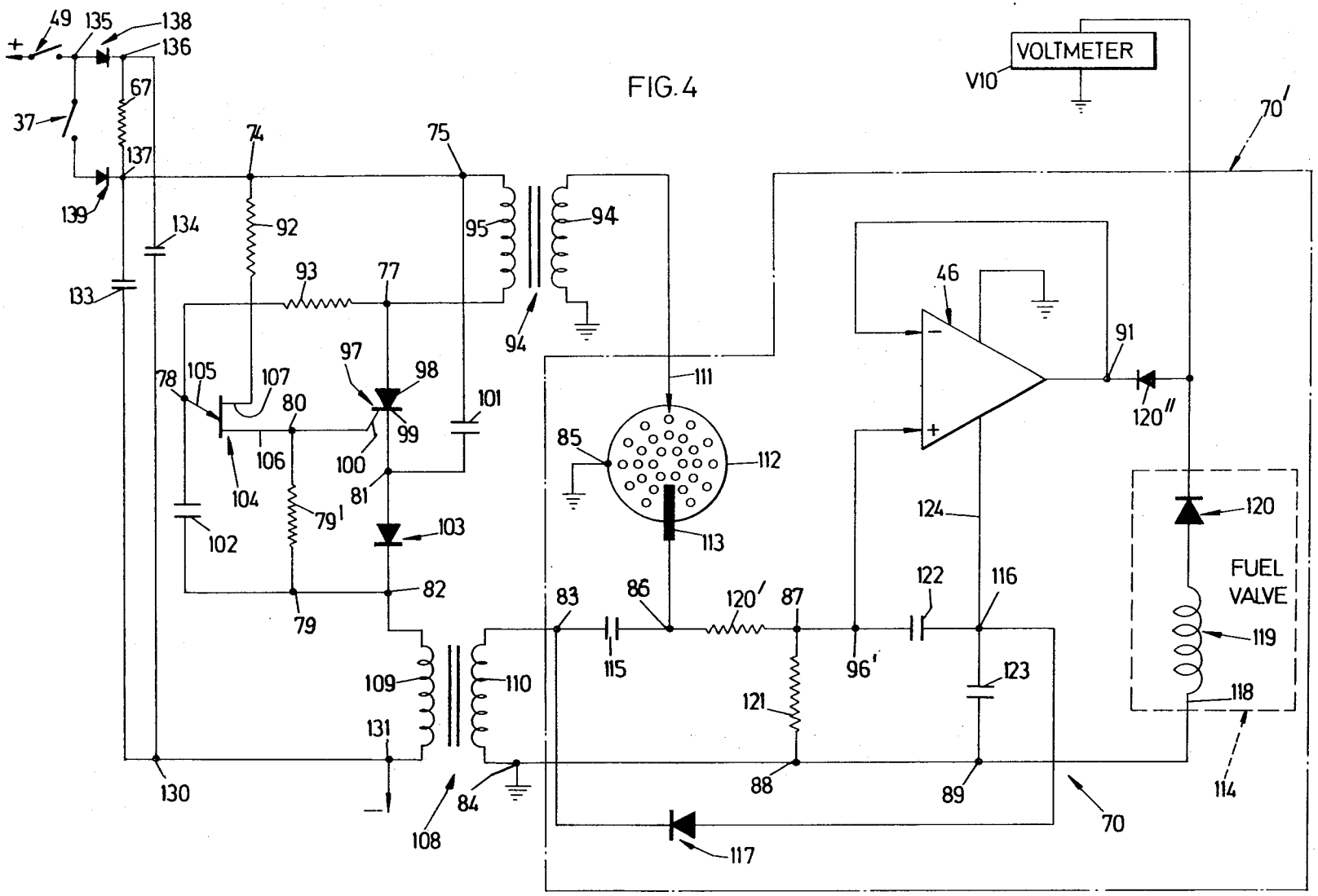
FIG. 4 is a schematic diagram of a spark ignitor and fuel valve control system.

Plus and minus signs are employed to indicate a connection to a respective terminal to power supply 43 except in the case of amplifier 46 shown in FIG. 4 where the plus and minus signs are employed respectively to indicate the noninverting and inverting inputs of the amplifier 46.

Figure 2:
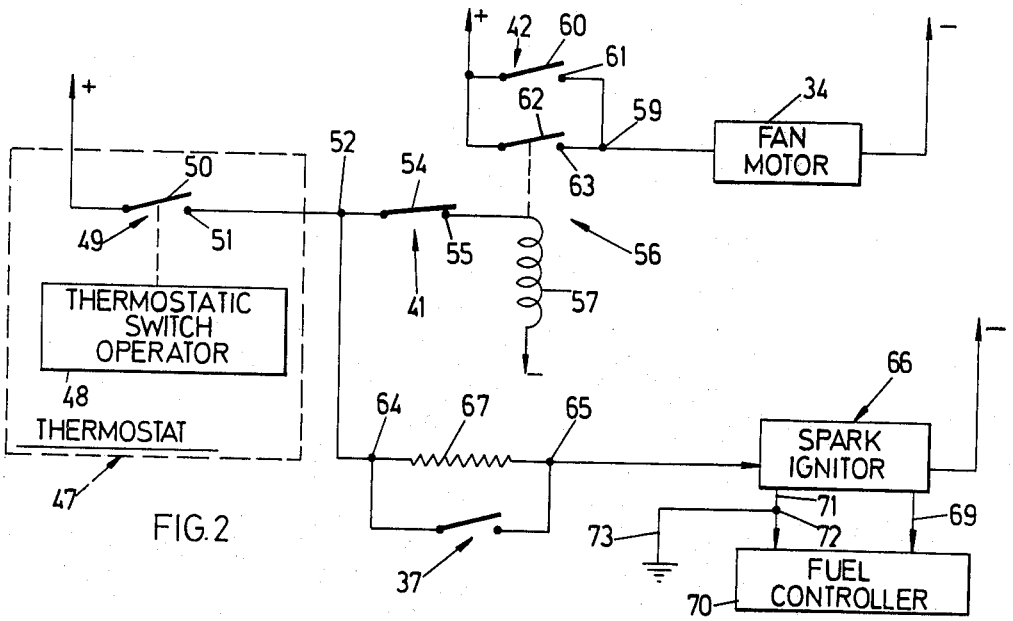
FIG. 2 is a block diagram of a portion of the system shown in FIG. 1.

The system of the present invention is employed to be operated by a thermostat 47 shown in FIG. 2 having a thermostatic switch operator 48 that closes a switch 49 when the temperature in the space to be heated falls below a predetermined or set point temperature. Switch 49 has a pole 50 and a contact 51. Pole 50 is connected to power supply terminal 44 which is positive. A junction is provided at 52. The normally closed bonnet switch is shown again at 41. Switch 41 has a pole 54 and a contact 55. Contact 51 and pole 54 are connected to junction 52. A relay 56, having a coil 57, has one end connected from switch contact 55 to negative power supply terminal 45. The normally open bonnet switch 42 is again shown in FIG. 2. Fan motor 34 has the same number and is connected from a junction 59 to the negative terminal 45 of power supply 43. Switch 42 has a pole 60 and a contact 61. Relay 56 operates a pole 62 which has a contact 63. Poles 60 and 62 are connected to the positive power terminal 44. Contacts 61 and 63 are connected to junction 59. A junction 64 is connected from junction 52. A junction 65 is connected to a spark ignitor 66 which is, in turn, connected to the negative terminal 45 of D.C. power supply 43. A resistor 67 is connected between junctions 64 and 65. The same is true of sail switch 37.

Spark ignitor 66 has an output lead 69 connected to fuel controller 70. Spark ignitor 66 also has an output lead 71 connected to a junction 72 that is, in turn, connected to controller 70. A lead 73 connects junction 72 to ground.

Spark ignitor 66 is shown in FIG. 4 with utilization means 70' including a controller 70. Various junctions are illustrated in FIG. 4 including junctions 130, 131, 135, 136 and 137. Junction 131 is connected to the negative terminal 45 of D.C. power supply 43. Junctions 130 and 131 are connected together. As shown in FIG. 4, switch 49 is again shown and is connected from the positive terminal 44 of D.C. power supply 43 to junction 135. Sail switch 37 is again shown with a diode 139 in FIG. 4, the same being connected in series in that order from junction 135 to junction 137, diode 139 being poled to be conductive toward junction 137.

A diode 138 is connected between junctions 135 and 136, and is poled to be conductive in a direction toward junction 136. A smoothing capacitor 134 is connected between junctions 130 and 136. Another smoothing capacitor 133 is connected between junctions 130 and 137. Resistor 67 is again shown in FIG. 4 and is connected between junctions 136 and 137.

The purpose of diodes 138 and 139 is to prevent the oscillator of the present invention from driving the D.C. power supply 43.

In accordance with the first embodiment of the present invention, D.C. power supply 43 may be a battery or a half wave or full wave rectifier which may be or is connected to the line of an A.C. voltage source. In other words, D.C. power supply 43 may also be a converter.

The circuit of FIG. 4 has various other junctions 74, 75, 77, 78, 79, 80, 81, 82, 83, 84, 85, 86, 87, 88, 89, 90 and 91. Junctions 74, 75 and 137 are connected together. A resistor 92 is connected between junction 74 and a second base 107 of a unijunction transistor 104. A resistor 93 is connected between junctions 77 and 78. A transformer 94 is provided having a primary winding 95 and a secondary winding 96. Primary winding 95 is connected between junctions 75 and 77. A silicon-controlled rectifier (SCR) is illustrated at 97 having an anode 98, a cathode 99 and a gate 100. Anode 98 is connected from junction 77 to junction 81 through cathode 99. A capacitor 101 is connected between junctions 75 and 81. A resistor 79' of one ohm, more or less, is connected between junctions 79 and 80. Gate 100 is connected from junction 80. A capacitor 102 is connected from junction 78 to junction 79. Junctions 79 and 82 are connected together. A diode 103 is connected between junctions 81 and 82, and poled to be conductive in a direction toward junction 82. Unijunction transistor 104 is provided with an emitter 105 and a first base 106 in addition to a second base 107. First base 106 is connected to junction 80. Emitter 105 is connected from junction 78. Another transformer 108 is provided having a primary winding 109 and a secondary winding 110. Primary winding 109 is connected from junction 82 to junction 131. In FIG. 4, the secondary winding 110 is connected between junctions 83 and 84, junction 84 being grounded.

The purpose of the transformers 94 and 108 are to provide for spark ignition and fuel valve control, respectively.

Transformers 108 and 94 have conventional (in themselves) ferrite cores 108' and 108'', respectively. Core 108' is not conventional in the system. Core 108'' is conventional in a spark ignitor. Core 108' prevents unwanted valve actuation upon oscillator failure. Core 108' also provides a good low impedance device for coupling the 1,000 Hz. signal to utilization means 70'.

As will be explained, it is an outstanding feature of the present invention that spark ignitor 66 includes an oscillator which provides a continuous spark when the thermostat calls for it whether or not gas is supplied. Moreover, the oscillator provides a voltage across primary 95 from capacitor 101 which is of the order of 80 volts when the power supply 43 supplies 12 volts D.C., filtered or not.

One end of transformer secondary 96 is connected to a spark electrode 111 which sparks to a main burner 112, shown in plan in FIG. 4, that is grounded from junction 85 therewith. A flame rod 113 is located over main burner 112 to be in contact with the flame and to close a fuel valve indicated at 114 when no flame exists. A capacitor 115 is connected between junctions 83 and 86. Flame rod 113 is positioned contiguous to main burner 112 but spaced therefrom in a position to be in contact with the flame. Flame rod 113 is connected to junction 86. A further junction 116 is provided from which a diode 117 is connected to junction 83 and is poled to be conductive in a direction toward junction 83. Junctions 84, 88 and 89 are all connected together and are connected also to one end 118 of the coil 119 of fuel valve 114. Preferably, diodes 120 and 120'' are connected from the other end of coil 119 to junction 91, and are both poled to be conductive toward junction 91. A voltmeter V10 for monitoring is connected from the anode of diode 120' to ground.

Preferably, diode 120 is packaged with fuel valve 114 so that use thereof may not be made except in accordance with the present invention. A resistor 120 is connected between junctions 86 and 87. A resistor 121 is connected between junctions 87 and 88. Junctions 87 and 90 are connected together. A capacitor 122 is connected between junctions 90 and 116. A capacitor 123 is connected between junctions 116 and 89. A lead 124 is provided which is the power input lead of amplifier 46. Lead 124 is connected from junction 116.

Junction 96 is connected to the noninverting input of amplifier 46. Junction 91 is connected to the inverting input of amplifier 46. Amplifier 46 has a gain of unity.

Amplifier 46 may be any conventional amplifier, but is preferably one which has short circuit (milliampere region) protection such as the one disclosed as model μA741 in Fairchild Semiconductor Integrated Circuits Catalog (November, 1971). Short circuiting of valve 114 is, therefore, permitted for testing.

OPERATION

In the operation of the circuit of the present invention, in FIG. 4, thermostat switch 49 closes. Sail switch 68 is not yet closed. A trickle charge is provided through resistor 67 charging capacitor 101. When sail switch 37 closes, the oscillator is connected directly across the line. Resistor 67 is shorted out. Resistors 92 and 93, unijunction 104 and capacitor 102 provide delayed firing of SCR 97. SCR 97 is not fired until capacitor 102 is adequately charged, i.e. the standoff ratio of unijunction 104 is reached. Unijunction 104 then fires SCR 97. This connects capacitor 101 directly across the primary 95 of transformer 94 through SCR 97.

It is an outstanding feature of the present invention that the ratio of the resonant frequency of capacitor 101 and primary 95 of transformer 94 is perhaps 100 times greater than the resonant frequency of capacitor 101 with the primary 109 of transformer 108. It is for this reason that SCR 97 is cut off at 90 electrical degrees. In this case, the circuit resonates at the lower frequency determined by the capacitance of the capacitor 101 and transformer primary 109.

Once the oscillator has started, the starting mechanism and structures including unijunction 104 and the circuit elements connected therewith and also resistor 97 have nothing to do with the operation.

When capacitor 101 and transformer primary 109 resonate, the resonant action terminates when the capacitor 101 charged to its maximum value with junction 75 being positive with respect to junction 81. This is true even though a power supply charging current back through the power supply would be possible. The reason this does not exist is that diode 103 prevents such further oscillation.

It is when the SCR 97 fires that the high frequency discharge of the energy of capacitor 101 in transformer primary 95 causes the spark to be generated between electrode 111 and main burner 112.

In FIG. 4, when the oscillator oscillates, junction 116 through the charge placed upon capacitor 123 causes junction 116 to have a potential of perhaps 12 volts negative with respect to ground. At the same time, capacitor 122 momentarily opens fuel valve 114 by the connection to amplifier 46 from junction 96. Diode 117 acts as a half wave rectifier to charge capacitor 123.

Resistors 120' and 121 act as a voltage divider.

Figure 6:
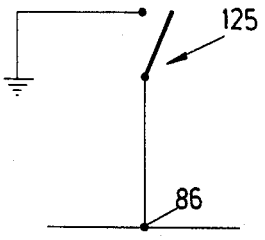
FIG. 6 is a view of a switch.
Figure 7:
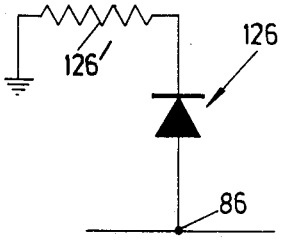
FIG. 7 is a view of a diode.

Flame rod 113 acts either as a normally open switch 125 illustrated in FIG. 6 or as a diode 126 and resistor 126' as illustrated in FIG. 7.

Capacitor 115 prevents the diode 126 from shorting secondary 110 of transformer 108.

Figure 5:
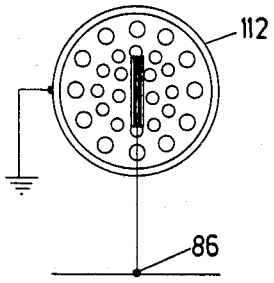
FIG. 5 is a top plan view of a flame rod and a main burner.

After momentary actuation of valve 114 through charging of capacitor 123 and through the use of capacitor 122, if the burner 112 is lit as shown in FIG. 5, flame rod 113 becomes the diode 126 and resistor 126' which allows a half wave rectified negative voltage to be placed across resistor 120' and resistor 121 to keep fuel valve 114 open. Filtering is provided by resistor 120' and capacitors 122 and 123 in series.

Figure 8:
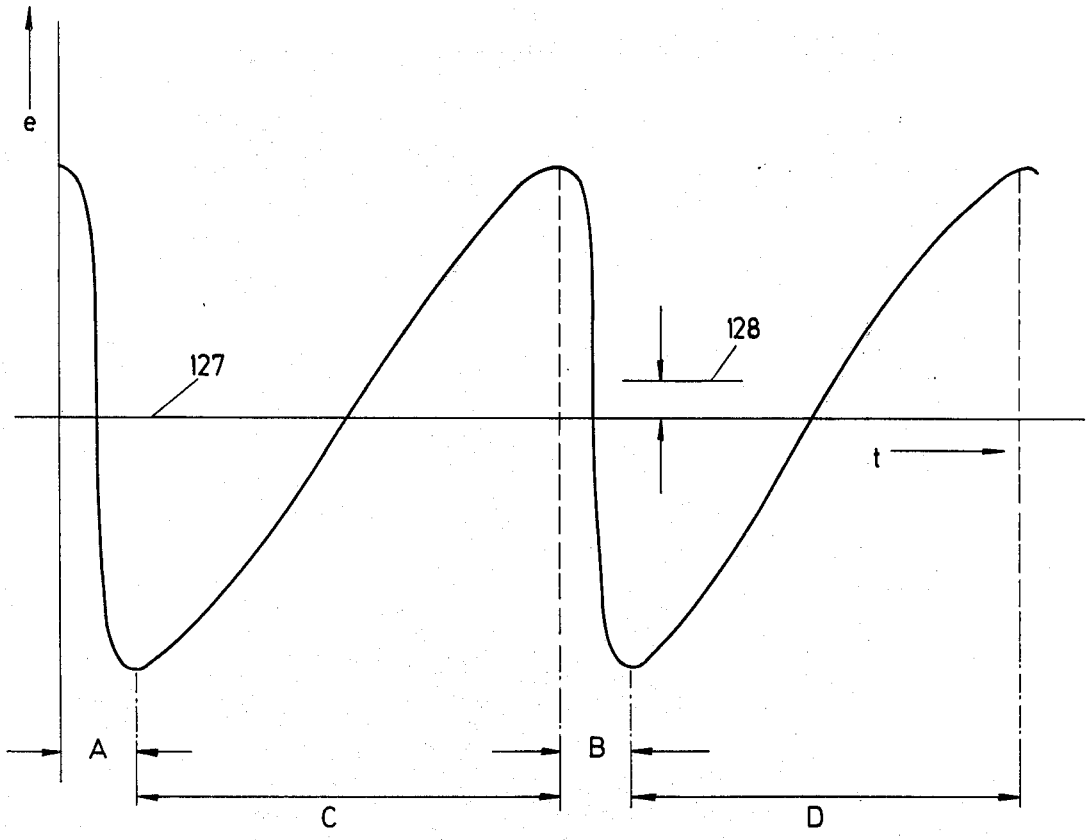
FIG. 8 is a graph of a waveform characteristic of the operation of the oscillator of the present invention.
Figure 9:
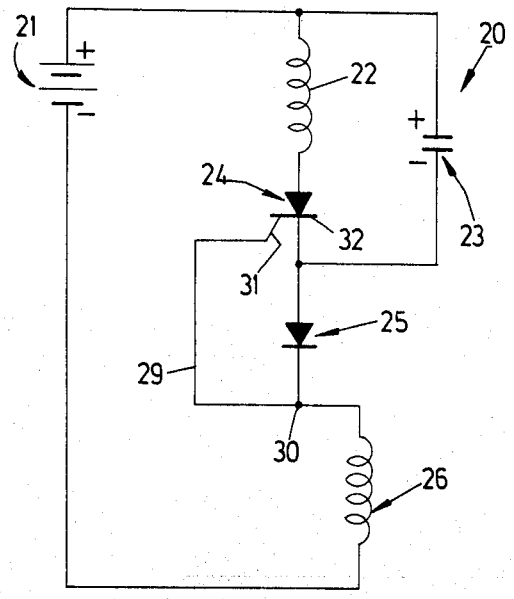
FIG. 9 is a schematic diagram of an alternative embodiment of the present invention.

The approximate voltage across a capacitor 23 shown in FIG. 9 is shown in FIG. 8.

An oscillator 20 constructed in accordance with the present invention is illustrated in FIG. 9 including a D.C. source of potential 21, an inductor 22, a silicon-controlled rectifier (SCR) 24, a diode 25 and an inductor 26 connected in a manner identical to similar components shown in FIG. 4.

Figure 10:
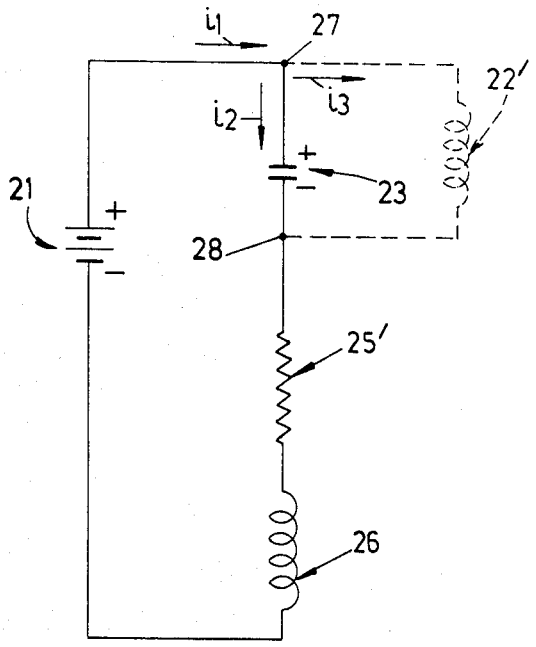
FIG. 10 is a schematic diagram illustrative of the operation of the circuit of FIG. 9.

The oscillator of FIG. 9 has three different successive modes of oscillation. When SCR 24 is cut off, the circuit of FIG. 9 looks as shown in FIG. 10, where diode 25 is illustrated as a resistor 25'. The resistance of diode 25 may be considered zero or infinite depending upon whether or not it is forward or back biased, respectively.

When SCR 24 is fired, the circuit of FIG. 9 looks the same as in FIG. 10 except that in FIG. 9, inductor 22 is, when SCR 24 is fired, connected in parallel with capacitor 23 at junctions 27 and 28 shown in FIG. 10.

If the resistance of 25' in FIG. 10 is zero, it is well known that $$i_o = I_m \sin(\omega_o t_o + \psi) \tag{1}$$

where, $i_o$ is the variable circuit current,
$t_o$ is time,
$I_m$ is the maximum circuit current, and
$\omega_o$ is the radian frequency of oscillation.
$I_m$ being defined by $$I_m = \frac{1}{\omega_o L_2} \sqrt{(E - E_o)^2 + \omega_o^2 L_2^2 I_o^2} \tag{2}$$

where, $L_2$ is the inductance of inductor 26,
$E$ is the voltage supplied by source 21,
$E_o$ is the voltage across capacitor 23 at $t_o = 0$, $E_o$ being positive when the polarity thereof is as shown in FIG. 10,
$I_o$ is the current of the FIG. 10 circuit at $t_o = 0$;
$\psi$ and $\omega_o$ being defined by $$\psi = \arctan \frac{\omega_o L_2 I_o}{E - E_o} \text{ and}$$
$$\omega_o = \frac{1}{\sqrt{L_2 C}} \tag{3}$$

where $C$ is the capacitance of capacitor 23.

The first oscillation of the FIG. 10 circuit can start ($t_o = 0$) at $E_o$  0 and $I_o = 0$, if desired, by closing the sail switch 37 shown in FIG. 4 (not shown in FIG. 10). The FIG. 10** circuit then can ring if underdamped. No advance trickle charge may be necessary if other circuit values are changed.

Due to the use of the diode 25, the circuit of FIG. 10 can never ring more than one cycle. The latter is due to the fact that diode 25 stops the ringing.

It is striking and unexpected that the peak voltage across capacitor 23 can and does grow for each of the lowest frequency cycles $1/(A + C)$ (see FIG. 8) of voltage oscillation across capacitor 23. This growth can be from, for example, a little above about 12 or 24 volts to about 80 volts peak-to-peak. The peak-to-peak voltage across capacitor 23 is limited by the losses and resistances in the circuit of FIG. 9 not shown therein. The growth of the voltage across the capacitor 23 will be explained in the following.

For a beginning, assume $$E_o = 0 \text{ and} \tag{4}$$
$$I_o = 0 \text{ at} \tag{5}$$
$$t_o = 0. \tag{6}$$

From equation (1), $$i_o = I_{mo} \sin \omega_o t_o \tag{7}$$

where, $$I_{mo} = \frac{E}{\omega_o L_2} \tag{8}$$

The voltage across capacitor 23 is then $$e_o = \frac{1}{C} \int i_o dt + C_1 \tag{9}$$

From equation (7), $$e_o = \frac{-I_{mo}}{C\omega_o} \cos \omega_o t_o + C_1 \tag{10}$$

When at $$t_o = 0 \tag{11}$$
$$e_o = 0 \tag{12}$$

then $$C_1 = \frac{I_{mo}}{C\omega_o} \tag{13}$$

From equations (10) and (13), $$e_o = \frac{Im_o}{C\omega_o}(1 - \cos \omega_o t_o) \tag{14}$$

Diode 25 always stops the oscillation of the FIG. 10 circuit when $e_o$ is at a positive peak with the polarity shown in FIG. 10. This peak is $$E_c = \frac{2Im_o}{C\omega_o} \tag{15}$$

From equations (8) and (14), $$E_c = 2E \tag{16}$$

In FIG. 9, when capacitor 23 reaches $E_c$, the voltage across inductor 26 reverses and lead 29 from junction 30 to SCR gate 31 fires SCR 24 because the connection of inductor 26 to junction 30 places SCR gate 31 at or about the potential of cathode 32 thereof.

When SCR 24 fires, the circuit looks the same as FIG. 10 except inductor 22 is connected between junctions 27 and 28 as indicated at 22'.

The circuit of FIG. 10 with inductor 22 added may be analyzed as follows by applying Kirchoff's law twice.

As stated previously, the circuit of FIG. 9 has three successive modes of operation, namely:

A. SCR 24 is cut off;

B. SCR 24 is fired and the capacitor voltage $e_1$ begins at peak $E_c$; and C. SCR 24 is fired and the capacitor voltage $e_o$ is equal to E to start with (time $t_k = 0$). (17)

The inductor 22 and the capacitor 23 have a current in mode (B), $$i = \frac{E_c}{\omega_1 L_1} \sin \omega_1 t \tag{18}$$

where, $i$ is the current, $$\omega_1 = \frac{1}{\sqrt{L_1 C}} \tag{19}$$

$L_1$ is the inductance of inductor 22, and $t$ is time.

The voltages $e_2$ and $e_1$ across inductor 22 and the capacitor 23 are then $$e_2 = E_c \cos \omega_1 t \text{ and} \tag{20}$$
$$e_1 = -E_c \cos \omega_1 t \tag{21}$$

However, in terms of $i_2$ and $i_3$, $$e_3 = -e_1 \text{ and} \tag{22}$$
$$i = i_2 = -i_3 \tag{23}$$

Thus $$e_3 = E_c \cos \omega_1 t \text{ and} \tag{24}$$

$$i_3 = \frac{-E_c}{\omega_1 L_1} \sin \omega_1 t \tag{25}$$

When $$e_3 = E,\ t = t_x \tag{26}$$
$$E = E_c \cos \omega_1 t_x \text{ and} \tag{27}$$

$$i_x = \frac{-E_c}{\omega_1 L_1} \sin \omega_1 t_x \tag{28}$$

$$i_x = \frac{-\sqrt{E_c^2 - E^2}}{\omega_1 L_1} \tag{29}$$

The next equation to develop for the next mode of operation is the capacitor current $i_3$ at and after the capacitor voltage $e_3$ is at and after $$e_3 = E. \tag{30}$$

$$E = \frac{1}{C} \int i_3\, dt_k + L_2 \frac{di_1}{dt_k} \tag{31}$$

$$i_1 = i_2 + i_3 \tag{32}$$

$$\frac{di_1}{dt_k} = \frac{di_2}{dt_k} + \frac{di_3}{dt_k} \tag{33}$$

$$E = \frac{1}{C} \int i_3\, dt_k + L_2 \left( \frac{di_2}{dt_k} + \frac{di_3}{dt_k} \right) \tag{34}$$

$$\frac{1}{C} \int i_3\, dt_k = L_1 \frac{di_2}{dt_k} \tag{35}$$

where, $E$ is the battery voltage, $C$ is the capacitor capacitance, $i_3$ is the capacitor current (see arrows in FIG. 10), $i_1$ is the current through inductor 26, $i_2$ is the current through inductor 22, $L_1$ is the inductance of inductor 22, $L_2$ is the inductance of the inductor 26, and $t_k$ is time.

Equation (34) combines (31) and (33). Equation (36) combines (34) and (35).

$$E = \left[ \frac{1}{C} + \frac{L_2}{L_1 C} \right] \left[ \int i_3 dt_k \right] + L_2 \frac{di_3}{dt_k} \tag{36}$$

$$L_2 \frac{d^2 i_3}{dt_k^2} + \left[ \frac{1}{C} + \frac{L_2}{L_1 C} \right] [i_3] = 0 \tag{37}$$

$$\frac{di_3^2}{dt_k^2} + \left[ \frac{1}{L_2 C} + \frac{1}{L_1 C} \right] [i_3] = 0 \tag{38}$$

Defining, $$\omega_o^2 = \frac{1}{L_2 C} \tag{39}$$

$$\omega_1^2 = \frac{1}{L_1 C} \tag{40}$$

$$\omega_2^2 = \omega_o^2 + \omega_1^2 \tag{41}$$

$$k = \frac{\omega_1}{\omega_o} \tag{42}$$

Equation (38) easily integrates by known methods to $$\left[ \frac{di_3}{dt_k} \right]^2 = -\omega_2^2 i_3^2 + C_1 \tag{43}$$

When $t_k = 0$, $$\frac{di_3}{dt_k} = \frac{E}{L_1} \tag{44}$$

and $i_3$ is determined as follows.

During the prior phase, $$i_2 = \frac{E_c}{\omega_1 L_1} \sin \omega_1 t_1 \tag{45}$$

$$e_3 = E_c \cos \omega_1 t_1 \tag{46}$$

where $E_c$ is the starting peak voltage in the first phase.

$$\cos \omega_1 t_1 = \frac{E}{E_c} \tag{47}$$

at $t_k = 0$, the magnitude of $i_3$ is $$\sin \omega_1 t_1 = \sqrt{1 - \frac{E^2}{E_c^2}} \quad (48)$$

Combining (43), (44) and (48), $$\frac{E^2}{L_1^2} = -\omega_2^2 \left(\frac{E_c^2 - E^2}{\omega_1^2 L_1^2}\right) + C_1 \quad (49)$$

$$C_1 = \frac{E^2}{L_1^2} + \left(\frac{E_c^2 - E^2}{\omega_1^2 L_1^2}\right)(\omega_2^2) \quad (50)$$

With (52), (49) easily integrates to $$i_3 = -a_1 \sin(\omega_2 t_k + \psi_k) \quad (51)$$

where, $$a_1 = \sqrt{\frac{E^2}{\omega_2^2 L_1^2} + \frac{E_c^2 - E^2}{\omega_1^2 L_1^2}} \text{ and} \quad (52)$$

$$\psi_k = \arctan \frac{\omega_2 \sqrt{\frac{E_c^2}{E^2} - 1}}{\omega_1} \quad (53)$$

$$L_1 \frac{di_2}{dt} = + \frac{1}{C} \int i_3 \, dt \quad (54)$$

$i_3$ is negative.

$$L_1 \frac{di_2}{dt} = \frac{a_1}{C\omega_2} \cos(\omega_2 t_k + \psi_k) + C_2 \quad (55)$$

$$E = \frac{a_1 \cos \psi_k}{C\omega_2} + C_2 \quad (56)$$

$$C_2 = E - \frac{a_1 \cos \psi_k}{C\omega_2} \quad (57)$$

$$\frac{di_2}{dt} = \frac{E}{L_1} - \frac{a_1 \cos \psi_k}{L_1 C\omega_2} + \frac{a_1 \cos(\omega_2 t_k + \psi_k)}{LC\omega_2} \quad (58)$$

$$i_2 = \left[\frac{E}{L_1} - \frac{a_1 \cos \psi_k}{CL_1\omega_2}\right][t_k] + \left[\frac{a_1}{C\omega_2^2 L_1} \sin(\omega_2 t_k + \psi_k)\right] + C_3 \quad (59)$$

$$\frac{E}{L_1} = \omega_2 a_1 \cos \psi_k \quad (60)$$

$$\frac{a_1\omega_2}{CL_1\omega_2^2} = a_1\omega_2 \left[\frac{k^2}{1 + k^2}\right] \quad (61)$$

When $k = \frac{\omega_1}{\omega_o}$ and (62)

$$k = 100 \quad (63)$$

$$i_2 = a_1 \sin(\omega_2 t_k + \psi_k) \quad (64)$$

To find $t_k = t_{ko}$ when $i_2 = 0$, $$\phi + \psi_k = \pi \quad (65)$$

The peak resulting voltage across the capacitor is $$E_p = \sqrt{(E - e_{ko})^2 + \omega_o^2 L_2^2 i_{ko}^2} \quad (66)$$

Where $$\beta = \phi + \psi_k \quad (66)$$

$$E_p = E_c \sqrt{(\cos\beta - \cos \psi_k) + k^2 \sin^2\beta} \quad (67)$$

$$\cos \beta = -1 \quad (68)$$

$$\sin \beta = 0 \quad (69)$$

$$\cos \psi_k = \frac{1}{R} \quad (70)$$

$$R = \frac{E_c}{E} \quad (71)$$

The voltage gain G is then $$G = 1 + \frac{1}{R} \quad (72)$$

This places the capacitor and battery with voltage polarities to add E to the capacitor voltage each time the oscillator goes through all three of its phases.

Note in an only voltage equation $$E_{pl} = E - E_o \quad (73)$$

The capacitor voltage $E_o$, if turned negative, adds to $E_{pl}$. This is done in the oscillator while the diode prevents charging the battery during capacitor voltage polarity reversal.

$k = 100$ is not necessarily optimum for all circumstances or maximum gain. $k$ may be varied from above 100 to much lower, e.g. to near $k = 1$ or $k = 2$. However, if $k$ is too low, the SCR will not cut off. With no losses, $k$ must be about $$k \geqq 4.5 \quad (74)$$

Maximum gain may be achieved at widely varying values other than $k = 100$. Many of the other values set forth herein may also be widely varied.

In FIG. 8, period C shows a half cycle of operation at frequency $\omega_o$. The same is true of half cycle D. e is voltage across capacitors 23 and 101. $t$ is time. What appears to be another half cycle of operation is illustrated as A or B in FIG. 8. This is not true. As explained previously, if line 127 is zero volts, the line 128 is 12 volts or E.

Within the periods A and B, above the line 128, the frequency is $\omega_1$. Below the line 128, the frequency is $\omega_2$. The frequency during the periods C and D is $\omega_o$.

As a fail safe measure, two capacitors may be connected in series between junctions 90 and 116 and in lieu of the one capacitor 122 in FIG. 4.

The phrase "source of D.C. potential" or any equivalent thereto is hereby defined to include, but not be limited to, a battery, a half wave rectifier, filtered or not, and a full wave rectifier, filtered or not.

The phase "inductor means" or any equivalent thereto and the phrase "inductor device" or any equivalent thereto, is hereby defined to include, but not be limited to, an inductor and/or a transformer.

With losses considered, the capacitor voltage $E_p$ is approximately $$E_p = (E + E_c e^{-\alpha_1 t_1})(e^{-\alpha_2 t_2}) \quad (75)$$

where, $$\alpha_1 = \frac{R_1 + R_3}{2L_1} \quad (76)$$

$R_1$ is the $L_1$ resistance,
$R_2$ is the $L_2$ resistance,
$R_3$ is the capacitor circuit resistance,
where $$\frac{R_2}{R_1} >> 1 \quad (77)$$

$$t_1 = \frac{\pi}{\omega_{10}} \quad (78)$$

$$\omega_{10} = \sqrt{\frac{1}{L_1 C} - \frac{(R_1 + R_3)^2}{4L_1^2}} \quad (79)$$

$$\alpha_2 = \frac{R_2 + R_3}{2L_2} \quad (80)$$

$$t_2 = \frac{\pi}{\omega_{01}}$$

$$\omega_{01} = \sqrt{\frac{1}{L_1 C} - \frac{(R_2 + R_3)^2}{4L_2^2}} \quad (81)$$

$$\frac{L_2}{L_1} = 10{,}000 \quad (82)$$

The gain G is thus $$G = \left(\frac{1}{R} + e^{-\alpha_1 t_1}\right)\left(e^{-\alpha_2 t_2}\right) \quad (83)$$

where $R = E_c/E$ (84)

The maximum capacitor voltage $E_m$ is approximately $$E_m = \frac{Ee^{-\alpha_2 t_2}}{1 - e^{-(\alpha_2 t_2 + \alpha_1 t_1)}} \quad (85)$$

For maximum gain, $R_1$, $R_2$ and $R_3$ should be as small as possible. $L_2$ should be as large as possible. C should be as small as possible. If $L_1$ is large, gain is increased. However, if $L_1$ is too large, the SCR will not cut off.

To prove $i_{20} = 0$ at $\beta = \pi$ for losses, in the first phase $$i_{10} = \frac{+E_c}{\omega_{10}L_1} e^{-\alpha t_{10}} \sin \omega_{10} t \quad (86)$$

$$i_{10x} = i_{10} \text{ at } t = t_{10x} \quad (87)$$

Find $t_{10x}$ from finding $e_{10}$ $$e_{10} = \frac{-E_c e^{-\alpha_{10} t} \sin\left(\omega_{10} t + \tan^{-1} \frac{\omega_{10}}{\alpha_{10}}\right)}{\omega_{10} L_1 C \sqrt{\alpha_{10}^2 + \omega_{10}^2}} \quad (88)$$

Find $t_{10x}$ from $$E = \frac{E_c e^{-\alpha_{10} t_{10x}} \sin\left(\omega_{10} t_{10x} + \tan^{-1} \frac{\omega_{10}}{\alpha_{10}}\right)}{\omega_{10} L_1 C \sqrt{\alpha_{10}^2 + \omega_{10}^2}} \quad (89)$$

The second phase is $$i_{30} = +a_{30} e^{-\alpha_{30} t} \sin(\omega_{30} t + \psi_{30}) \quad (90)$$

where $$a_{30} = \sqrt{\left(\frac{\frac{R_1 E}{R_1 + R_2} - E - \frac{R_a i_{10x}}{2}}{\omega_{30} L_e}\right) + i_{10x}^2} \quad (91)$$

$$R_a = \frac{R_1 R_2}{R_1 + R_2} + R_3 \quad (92)$$

$$L_e = \frac{L_1 L_2}{L_1 + L_2} \quad (93)$$

$$\omega_{20} = \frac{1}{L_e C} - \frac{R_a^2}{4L_e^2} \quad (94)$$

$$\alpha_{20} = \frac{R_a}{2L_e} \quad (95)$$

Note if $$K^2 = \frac{L_2}{L_1} \quad (96)$$

then, in general, $$K^2 = \frac{R_2}{R_1} \quad (97)$$

$$\frac{R_1 E}{R_1 + R_2} - E = \frac{E}{1 + K^2} - E \quad \text{and} \quad (98)$$

$$\frac{E}{1 + K^2} \quad (99)$$

is very small if $$K^2 = 10{,}000 \quad (100)$$

Also $$R_a = \frac{R_1}{1 + \frac{1}{K^2}} + R_3 \quad \text{and} \quad (101)$$

$$L_e = \frac{L_1}{1 + \frac{1}{K^2}} \quad (102)$$

$$\psi_{30} = \tan^{-1} \frac{\omega_{30} L_e i_{10x}}{\frac{-K^2 E}{1 + K^2} - \frac{R_a i_{10x}}{2}} \quad (103)$$

$\psi_{30}$ is third quadrant. $i_{10x}$ is negative.

$$e_{30} = \frac{-a_{30} e^{-\alpha_{30} t} \sin\left(\omega_{30} t + \psi_{30} + \tan^{-1} \frac{\omega +}{\alpha_{30}}\right)}{C\sqrt{\alpha_{30}^2 + \omega_{30}^2}} + \frac{E}{1 + K^2} \quad (104)$$

$$L_1 \frac{di_{20}}{dt} + i_{20} R_1 = i_{30} R_3 + \frac{1}{C} \int i_{30} dt \quad (105)$$

This integrates by formula. Where if $$R_o = \frac{i_{30} R_3}{L_1} + \frac{1}{L_1 C} \int i_{30} dt \quad (106)$$

$$i_{20} = C_y e^{-\frac{R_1}{L_1} t} + e^{-\frac{R_1 t}{L_1}} \int R_o e^{\frac{R_1 t}{L_1}} dt \quad (107)$$

and where $C_y$ is the only constant after the $e_{30}$ integration.

$$i_{20} = C_y e^{-\frac{R_1}{L_1} t} + \frac{a_{30} R_3 e^{-\alpha_{30} t} \sin\left(\omega_{30} t + \psi_{30} - \tan^{-1} \frac{\omega_{30}}{\alpha_{40}}\right)}{L_1 \sqrt{\alpha_{40}^2 + \omega_{30}^2}} - \frac{a_{30} e^{-\alpha_{30} t} \sin\left(\omega_{30} t + \psi_{30} + \tan^{-1} \frac{\omega_{30}}{\alpha_{30}} - \tan \frac{\omega_{30}}{\alpha_{40}}\right)}{L_1 C \sqrt{\alpha_{30}^2 + \omega_{30}^2} \sqrt{\alpha_{40}^2 + \omega_{30}^2}} + \frac{E}{R_1 (1 + K^2)} \quad (108)$$

where $$\alpha_{40} = \frac{R_1}{L_1} - \alpha_{30} \quad \text{and} \quad (109)$$

$$\frac{R_1}{L_1} - \alpha_{30} = \frac{R_1}{L_1} - \frac{R_a}{2L_e} \quad (110)$$

$$\frac{R_a}{2L_e} \cong \frac{R_1 + R_3}{2L_1} \quad (111)$$

$$\alpha_{40} \cong \frac{R_1 - R_3}{2L_1} \quad (112)$$

$$i_{20} = C_u e^{\frac{R_1 t}{L_1}} - a_{30} e^{-\alpha_{30} t} \sin(\omega_{30} t + \psi_{30}) + \frac{E}{R_1(1+K^2)} \quad (113)$$

$$C_u = i_{20x} + a_{30} \sin \psi_{30} - \frac{E}{R_1(1+K^2)} \quad (114)$$

where, $$i_{20x} = -i_{10x} \text{ and} \quad (115)$$
$$i_{10x} = a_{30} \sin \psi_{30} \quad (116)$$

$i_{10x}$ is negative. $\psi_{30}$ is third quadrant. Thus, $$C_u = -\frac{E}{R_1(1+K^2)} \text{ and} \quad (117)$$

$$i_{20} = \frac{E\left(1 - e^{-\frac{R_1 t}{L_1}}\right)}{R_1(1+K^2)} - d_{30} e^{-\alpha_{30} t} \sin(\omega_{30} t + \psi_{30}) \quad (118)$$

From $$\frac{+K^2 E}{1+K^2} = \frac{-R_a i_{10x}}{2} - \omega_{30} L_e a_{30} \cos \psi_{30} \quad (119)$$

where, $$R_a = R_1 + R_3 \quad (120)$$
$$i_{10x} = a_{30} \sin \psi_{30} \quad (121)$$

$$i_{20} = -\left[\left(\frac{1 + \frac{R_3}{R_1}}{2K^2}\right)(a_{30} \sin\psi_{30}) \quad \frac{+\omega_{30} L_e a_{30} \cos\psi_{30}}{K^2 R_1}\right] \times \left[1 - e^{-\frac{R_1 t}{L_1}}\right] - a_{30} e^{-\alpha_{30} t} \sin(\omega_{30} t + \psi_{30}) \quad (122)$$

$$L_e = L_1 \quad (123)$$

The worst case is $$\psi_{30} = 0 \quad (124)$$

Thus, when $i_{20} = 0$, ($a_{30}$ is negative)

$$\left[\frac{\omega_{30} L_1}{K^2 R_1}\right]\left[1 - e^{-\frac{R_1 t_{20x}}{L_1}}\right] = -e^{-\alpha_{30} t_{20x}} \sin \omega_{30} t_{20x} \quad (125)$$

If $\omega_{30} t_{20x}$ is 180° to 188° and $$\frac{R_1 t_{20x}}{L_1} << 1 \text{ and} \quad (126)$$

$$\alpha_{30} t_{20x} << 1 \quad (127)$$

$$\frac{\omega_{30} t_{20x}}{K^2} = (1 - \alpha_{30} t_{20x})(\omega_{30} t_{20x} - \pi) \quad (128)$$

$$[\omega_{30} t_{20x}]\left[1 - \frac{1}{K^2(1 - \alpha_{30} t_{20x})}\right] = \pi \quad (129)$$

$$[\omega_{30} t_{20x}]\left[\frac{K^2 - \frac{1}{(1 - \alpha_{30} t_{20x})}}{K^2}\right] = \pi \quad (130)$$

Because $$\alpha_{30} t_{20x} << 1 \quad (131)$$

approximately $$(\omega_{30} t_{20x})\left(\frac{K^2 - 1}{K^2}\right) = \pi \quad (132)$$

Thus, if $$K^2 = 10{,}000 \quad (133)$$

almost exactly $$\omega_{30} t_{20x} = \pi \quad (134)$$

Figure 11:
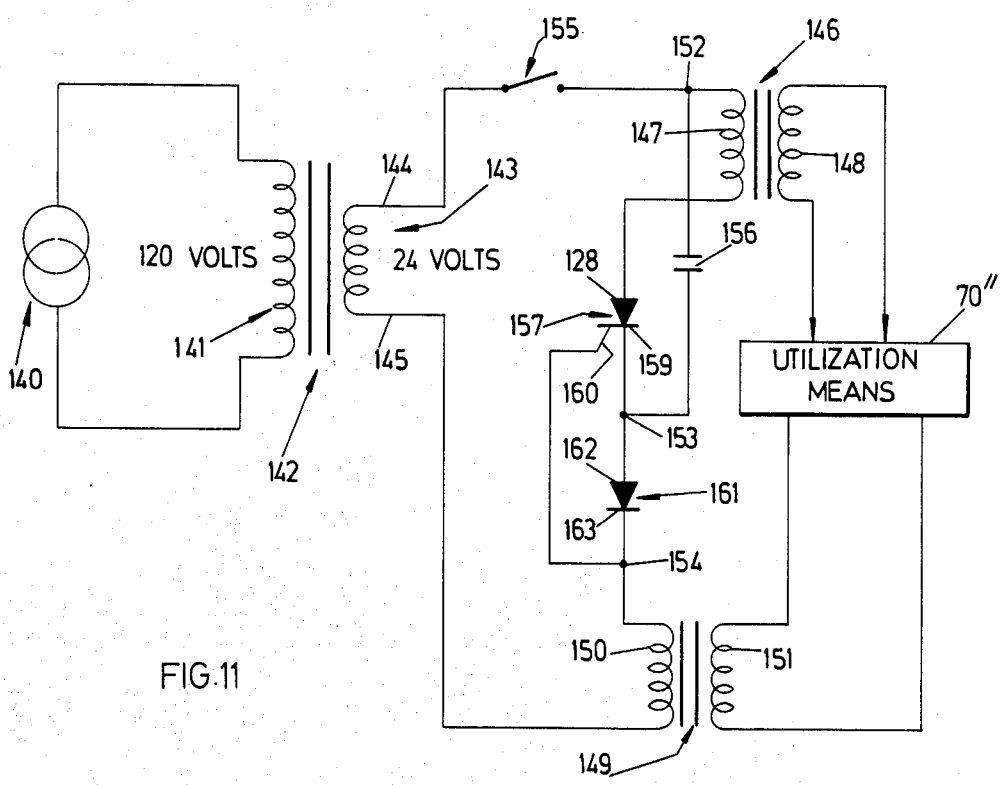
FIG. 11 is a schematic diagram of still another embodiment of the present invention.

In FIG. 11, an A.C. source of potential 140 is illustrated. Source 140 is connected across the primary 141 of a transformer 142 having a secondary 143 with upper and lower leads 144 and 145, respectively.

Utilization means 70'' are also illustrated in FIG. 11 which may be identical to utilization means 70' illustrated in FIG. 4.

A transformer 146 is illustrated in FIG. 11 having a primary winding 147 and a secondary winding 148. Secondary winding 148 is connected to utilization means 70''. If desired, transformer 146 may be identical to transformer 94 shown in FIG. 4.

Also shown in FIG. 11 is a transformer 149 having a primary 150 and a secondary 151. Secondary 151 is also connected to utilization means 70''. If desired, transformer 149 may be identical to transformer 108 shown in FIG. 4. Junctions 152, 153 and 154 are shown in FIG. 11. A switch 155 of a thermostat is connected in series between transformer secondary lead 144 and junction 152. A capacitor 156 is connected between junctions 152 and 153. A silicon-controlled rectifier 157 is illustrated in FIG. 11 having an anode 158, a cathode 159 and a gate 160. Anode 158 is connected from the lower end of transformer primary 147, the upper end thereof being connected to junction 152.

Cathode 159 is connected to junction 153. A diode is provided at 161 having an anode 162 connected from junction 153 and a cathode 163 connected to junction 154.

Gate 160 is connected to junction 154.

Transformer primary 150 has one end connected to junction 154 and its other end connected to lead 145 of transformer secondary 143.

Although the circuit of FIG. 11 looks much like and may employ many components identical to respective ones in the oscillator of the present invention illustrated in FIGS. 2, 3, 4, 9 and 10, the circuit of FIG. 11 is not an oscillator. It is operated strictly by the A.C. input thereto supplied thereto by source 140 through transformer 142.

The phrase "means providing an A.C." or other source of potential or an equivalent phrase is hereby defined for use herein and for use in the claims to means one or more conductive leads or otherwise.

The phrase "utilization means" is hereby defined for use herein and for use in the claims to mean means 70' or means 70'' or the electrode means of a spark ignitor or otherwise.

Notwithstanding the foregoing, transformers 108 and 94 may have cores other than ferrite cores which are either conventional or not.

What is claimed is:

1. A spark ignitor for a combustible fuel, said ignitor comprising: a first junction; a first switch for connection to a conductor having a positive potential to said first junction; first and second inductive means each having first and second leads; a charging resistor connected from said first junction to said first inductive means first lead; a second switch for closure after said first switch is connected in parallel with said charging resistor; a silicon-controlled rectifier (SCR) having an anode, a cathode and a gate, said anode being connected from said first inductive means second lead; a diode having an anode connected from said SCR cathode, and a cathode connected to said second inductive means first lead, said second inductive means second lead being adapted for connection to a conductor of a negative potential; a main capacitor connected from said first inductive means first lead to said diode anode; said diode cathode being connected to said SCR gate; a second junction connected from said first inductive means first lead; starting means and hold off connected from said second junction to said SCR gate to fire said SCR when said second switch is closed; and conductor means connected with said first inductive means to establish an arc when the energy stored in said main capacitor is transferred to said first inductive means, said starting and hold off means including first and second resistors, a unijunction transistor having an emitter and first and second bases, an auxiliary capacitor, and third, fourth and fifth junctions, said first resistor being connected between said second and third junctions, said second resistor being connected between said third and fourth junctions, said SCR anode being connected from said fourth junction, said transistor second base being connected from said third junction, said transistor emitter being connected from said fifth junction, said auxiliary capacitor being connected from said fifth junction to said SCR gate, said transistor first base being connected to said SCR gate, said first and second inductive means including first and second transformers, respectively, each said transformer having primary and secondary windings, said first transformer primary winding having first and second ends connected to said first and second leads of said first inductive means, respectively, said second transformer primary winding having first and second ends connected to said first and second leads of said second inductive means, respectively, each of said secondaries having first and second leads, said conductor means including first and second spaced conductive structures, said first transformer primary having said first and second leads thereof connected to said first and second spaced conductive structures, respectively, to establish an arc therebetween, a main fuel burner, a gas valve having a winding actuable to supply fuel to said burner, said structures being in proximity to said burner to ignite fuel emanating therefrom by said arc, and means connected from said second transformer primary for actuating said valve.

2. The invention as defined in claim 1, wherein one of said structures includes a ground for said main burner, first, second and third capacitors, first and second resistors, a flame rod supported over said main burner, first and second diodes, a differential amplifier having noninverting and inverting input leads, an output lead, and power input and output leads, first, second, third, fourth, fifth and sixth junctions, said second transformer secondary second lead being connected to said fifth, sixth and seventh junctions and to ground, said first capacitor being connected between said first and second junctions, said flame rod being connected from said second junction, said first resistor being connected between said second and third junctions, said second resistor being connected between said third and sixth junctions, said second capacitor being connected between said third and fourth junctions, said third capacitor being connected between said fourth and fifth junctions, said amplifier output lead being connected to said seventh junction, said inverting input lead being connected from said seventh junction, said noninverting input lead being connected from said fourth junction, said first diode and said gas valve winding being connected in series between said fifth and seventh junctions, said first diode being poled to be conductive toward said seventh junction, said second diode being connected between said first and fourth junctions and being poled to be conductive toward said first junction, said power input lead being connected from said fourth junction, said power output lead being grounded.

3. Apparatus for periodically producing first signal portions of a higher frequency and for periodically producing second signal portions alternately with said first signal portions, said second signal portions being of a frequency lower than said higher frequency, said apparatus comprising: means for providing a source of potential including first and second leads; a circuit connected between said first and second leads, said circuit including first, second and third junctions, first and second inductor means, a capacitor, a silicon-controlled rectifier (SCR) having an anode, a cathode and a gate, and a diode, said first lead being connected to said first junction, said first inductor means being connected from said first junction to said SCR anode, said capacitor being connected between said first and second junctions, said SCR cathode being connected to said second junction, said diode being connected between said second and third junctions and being poled to be conductive toward said third junction, said second inductor means being connected from said third junction to said second lead, said SCR gate being connected from said third junction; and utilization means coupled to said circuit, said utilization means including spark electrode means for ignition of a combustible fuel, said utilization means also including a burner, a valve connected to said burner to control the supply of said fuel thereto, said valve having a solenoid-type operator coupled to said circuit in a manner to open said valve when a predetermined voltage is supplied to said circuit over said first and second leads.

4. Apparatus for periodically producing first signal portions of a higher frequency and for periodically producing second signal portions alternately with said first signal portions, said second signal portions being of a frequency lower than said higher frequency, said apparatus comprising: means for providing a source of potential including first and second leads; a circuit connected between said first and second leads, said circuit including first, second and third junctions, first and second inductor means, a capacitor, a silicon-controlled rectifier (SCR) having an anode, a cathode and a gate, and a diode, said first lead being connected to said first junction, said first inductor means being connected from said first junction to said SCR anode, said capacitor being connected between said first and second junctions, said SCR cathode being connected to said second junction, said diode being connected between said second and third junctions and being poled to be conductive toward said third junction, said second inductor means being connected from said third junction to said second lead, said SCR gate being connected from said third junction; and utilization means coupled to said circuit, at least one of said inductor means including a first transformer having a primary winding connected in said circuit, and a secondary winding connected to said utilization means, the other of said inductor means including a second transformer having a primary winding connected in said circuit, and a secondary winding connected to said utilization means, said utilization means including spark electrode means for ignition of a combustible fuel connected from said first transformer secondary, said utilization means also including a burner, a valve connected to said burner to control the supply of said fuel thereto, said valve having a solenoid-type operator coupled to said circuit in a manner to open said valve when a predetermined voltage is supplied to said circuit over said first and second leads, said operator being connected from said second transformer secondary.

5. The invention as defined in claim 4, wherein said predetermined voltage is a D.C. voltage.

6. The invention as defined in claim 4, wherein said predetermined voltage is an A.C. voltage.

7. Fuel-burning apparatus comprising: a burner; first means actuable to admit fuel to said burner; a spark ignitor actuable to cause combustion of fuel at said burner; second means to supply a rectified output to said ignitor of an A.C. input voltage of a lower frequency, said ignitor including an oscillator adapted to oscillate at a fundamental frequency higher than said input voltage; third means responsive to an A.C. output voltage of said higher frequency to actuate said first means; and a transformer coupling said A.C. output voltage from said oscillator to said third means, said transformer having a ferrite core.

8. The invention as defined in claim 7, wherein said lower frequency is between about 50 Hz to 60 Hz, said higher frequency being much larger than said lower frequency.

9. The invention as defined in claim 8, wherein said higher frequency is about 1,000 Hz.

10. An electrical control system for supplying and igniting a combustible fuel, said system comprising: igniter means actuable to ignite the fuel; a burner; a fuel valve connected to said burner and having a winding actuable to allow fuel to enter said burner; first means connected from said igniter means to actuate said valve winding momentarily; a flame detector positioned adjacent said burner; and second means connected from said igniter means and said flame detector to actuate said valve winding continuously so long as said igniter means is in operation and a flame exists at said burner, said igniter means including an oscillator, said oscillator including a transformer having primary and secondary windings, said oscillator having a circuit including said primary winding, said secondary winding having first and second secondary leads, said first means including first and second capacitors connected across said secondary, a diode connected from the mutual junction of said first and second capacitors to one of said first and second secondary leads, and third means connecting one lead of one of said first and second capacitors other than that connected to said mutual junction to said valve winding.

11. An electrical control system for supplying and igniting a combustible fuel, said system comprising: igniter means actuable to ignite the fuel; a burner; a fuel valve connected to said burner and having a winding actuable to allow fuel to enter said burner; first means connected from said igniter means to actuate said valve winding momentarily; a flame detector positioned adjacent said burner; and second means connected from said igniter means and said flame detector to actuate said valve winding continuously so long as said igniter means is in operation and a flame exists at said burner, said igniter means including an oscillator, a junction being provided, said flame detector including a flame rod connected from said junction, said oscillator including a transformer having primary and secondary windings, said oscillator having a circuit including said primary winding, said secondary winding having first and second secondary leads, a capacitor connected between said first secondary lead and said junction, third means connecting said junction to said valve winding, and a resistor connected between said junction and said secondary lead.

12. The invention as defined in claim 10, wherein said flame detector includes a flame rod connected with one junction of said one lead of said one of said first and second capacitors other than said mutual junction thereof, and a resistor connected between said one junction and another junction with the other of said first and second capacitors other than said mutual junction thereof, and a third capacitor connected between one of said first and second secondary leads and said one junction.

* * * * *